US005699868A

United States Patent [19]

Caraway et al.

[11] Patent Number: 5,699,868

[45] Date of Patent: Dec. 23, 1997

[54] ROTARY DRILL BITS HAVING NOZZLES TO ENHANCE RECIRCULATION

[75] Inventors: Douglas Caraway, Kingwood, Tex.; Graham Watson, Frampton-on Severn, England; T. Alex Newton, Houston, Tex.

[73] Assignee: Camco Drilling Group Limited, Stonehouse, England

[21] Appl. No.: 637,985

[22] Filed: Apr. 24, 1996

[30] Foreign Application Priority Data

May 11, 1996 [GB] United Kingdom ..... 9509555

[51] Int. Cl.[6] ..... E21B 10/18

[52] U.S. Cl. ..... 175/339; 175/400

[58] Field of Search ..... 175/339, 324, 175/393, 400, 417, 418, 429, 431

[56] References Cited

U.S. PATENT DOCUMENTS

| | | | |
|---|---|---|---|
| 2,493,178 | 1/1950 | Williams, Jr. | 175/400 |
| 2,931,630 | 4/1960 | Grady | 175/400 |
| 4,098,363 | 7/1978 | Rohde et al. | 175/400 X |
| 4,189,014 | 2/1980 | Allen et al. | 175/339 |
| 4,574,895 | 3/1986 | Dolezal et al. | 175/400 X |
| 4,606,418 | 8/1986 | Thompson | 175/339 X |
| 4,676,324 | 6/1987 | Barr et al. | 175/393 |
| 4,697,654 | 10/1987 | Barr et al. | 175/400 X |
| 4,848,489 | 7/1989 | Deane | 175/400 X |
| 4,883,136 | 11/1989 | Trujillo | 175/339 |

FOREIGN PATENT DOCUMENTS 2277760 11/1994 United Kingdom .

*Primary Examiner*—Frank Tsay

[57] ABSTRACT

A rotary drill bit for drilling holes in subsurface formations comprises a bit body having a leading face and a gauge region, and a plurality of blades formed on the leading face of the bit body and extending outwardly away from the axis of the bit towards the gauge region so as to define a fluid flow channel between the leading edge of each blade and the trailing edge of the adjacent preceding blade. A plurality of cutting elements are mounted along the leading edge of each blade, and there is provided, in one or more of the channels, a main nozzle which directs fluid along the leading edge of one blade so as to clean and cool the cutting elements on it, and a subsidiary nozzle which is located and orientated so as to direct fluid along the trailing edge of the preceding blade in a direction opposite to the direction of flow from the main nozzle, so as to tend to enhance partial recirculation of fluid flow in the flow channel between the blades.

12 Claims, 3 Drawing Sheets

ROTARY DRILL BITS HAVING NOZZLES TO ENHANCE RECIRCULATION

BACKGROUND OF THE INVENTION

1. Field of the Invention

The invention relates to rotary drill bits for use in drilling or coring holes in sub-surface formations and particularly to drag-type drill bits of the kind comprising a bit body having a leading face and a gauge region, a plurality of blades formed on the leading face of the bit and extending outwardly away from the axis of the bit towards the gauge region so as to define a fluid flow channel between the leading edge of each blade and the trailing edge of the adjacent preceding blade, a plurality of cutting elements mounted along the leading edge of each blade, and a plurality of nozzles in the leading face of the bit for supplying drilling fluid to the flow channels for cleaning and cooling of the cutting elements.

2. Description of Related Art

One of the major problems in designing a drag-type drill bit lies in positioning and orientating the nozzles so as to provide the most effective flow pattern of drilling fluid along the channels and across the cutting elements to obtain the optimum cleaning and cooling effect. The flow of drilling fluid emerging from the nozzles and impinging on the surface of the formation being drilled also serves to cool the formation.

Normally the nozzles are located in the area around the central axis of rotation of the bit so that substantially all of the drilling fluid emerging from the nozzles flows outwardly along the channels with which the nozzles communicate, so as to wash over the cutting elements facing into the channels.

It is believed that the cleaning and cooling effect of the flow of drilling fluid in the flow channels may be enhanced by generating some recirculating flow of drilling fluid within each flow channel in addition to the general flow of fluid to the outer periphery of the drill bit. The present invention therefore provides an improved arrangement whereby nozzles are so located and orientated as to tend to generate such recirculating flow.

SUMMARY OF THE INVENTION

According to the invention there is provided a rotary drill bit for use in drilling holes in subsurface formations comprising a bit body having a leading face and a gauge region, a plurality of blades formed on the leading face of the bit body and extending outwardly away from the axis of the bit towards the gauge region so as to define a fluid flow channel between the leading edge of each blade and the trailing edge of the adjacent preceding blade, and a plurality of cutting elements mounted along the leading edge of each blade, wherein there is provided, in at least one of said channels, a main nozzle which is located and orientated so as to direct at least the majority of fluid emerging therefrom along the leading edge of one blade so as to clean and cool the cutting elements mounted thereon, and a subsidiary nozzle which is located and orientated so as to direct at least the majority of fluid emerging therefrom along the trailing edge of the blade preceding said one blade in a direction substantially opposite to the direction of flow of fluid from the main nozzle, so as to tend to enhance partial recirculation of fluid flow in said flow channel between the blades.

Preferably the subsidiary nozzle is spaced radially from said main nozzle. For example, one nozzle may be located adjacent the center of the bit and the other nozzle may be located adjacent the outer periphery of the bit. The subsidiary nozzle may be spaced forwardly from the main nozzle in a circumferential direction.

The main nozzle may be located and orientated to direct at least the majority of fluid emerging therefrom outwardly away from the central axis of the bit, the subsidiary nozzle being located and orientated to direct at least the majority of fluid emerging therefrom inwardly towards the central axis of the bit. Alternatively, the main nozzle may be located and orientated to direct at least the majority of fluid emerging therefrom inwardly towards the central axis of the bit, the subsidiary nozzle being located and orientated to direct at least the majority of fluid emerging therefrom outwardly away from the central axis, but the subsidiary nozzle might be arranged to generate a greater flow rate instead. Preferably, the main nozzle is such as to generate a greater flow rate than the subsidiary nozzle.

The main and subsidiary nozzle arrangement according to the invention may be provided in some or all of the flow channels provided on the bit body. In the case where main and subsidiary nozzles according to the invention are provided in only some flow channels, they are preferably provided in alternate flow channels around the bit.

DETAILED DESCRIPTION OF THE PREFERRED EMBODIMENTS

Figure 1:
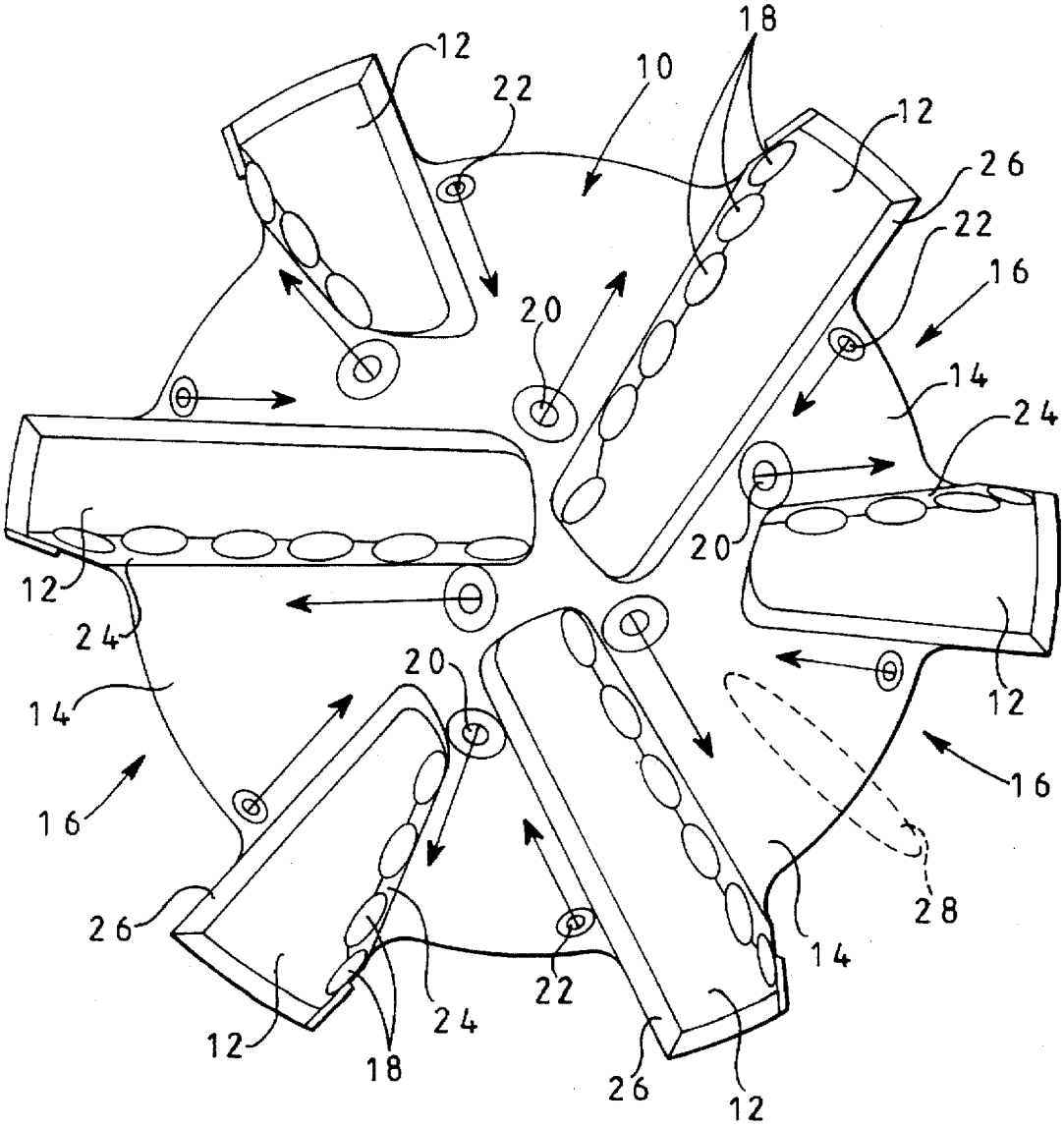
FIG. 1 is a diagrammatic end view of one form of rotary drill bit in accordance with the invention.

The drill bit comprises a bit body 10 and six blades 12 formed on the leading face of the bit and extending outwardly from the axis of the bit body towards the gauge region. Between adjacent blades there are defined fluid flow channels 14 which lead respectively to junk slots 16.

Extending side-by-side along the leading edge of each of the blades are a plurality of cutting structures indicated diagrammatically at 18. The precise nature of the cutting structures does not form a part of the present invention and they will not therefore be described in detail. They may be of any appropriate type. For example, they may comprise circular preform cutting elements brazed to cylindrical carriers which are embedded or mounted in the blades, the cutting elements each comprising a preform compact having a polycrystalline diamond front cutting layer bonded to a tungsten carbide substrate, the compact being brazed to a cylindrical tungsten carbide carrier.

The general manner of construction of drag bits of this kind is well known and will not therefore be described in detail. The bit body may be machined from steel or may be molded from powdered matrix material using a powder metallurgy process.

Nozzles 20, 22 are mounted in the surface of the bit body in each flow channel 14 between the leading edge 24 of one blade and the trailing edge 26 of the preceding adjacent blade. The nozzles 20, 22 may be of generally known form comprising a separate nozzle element screwed into a socket in the bit body and formed with an appropriately shaped nozzle aperture.

Figure 2:
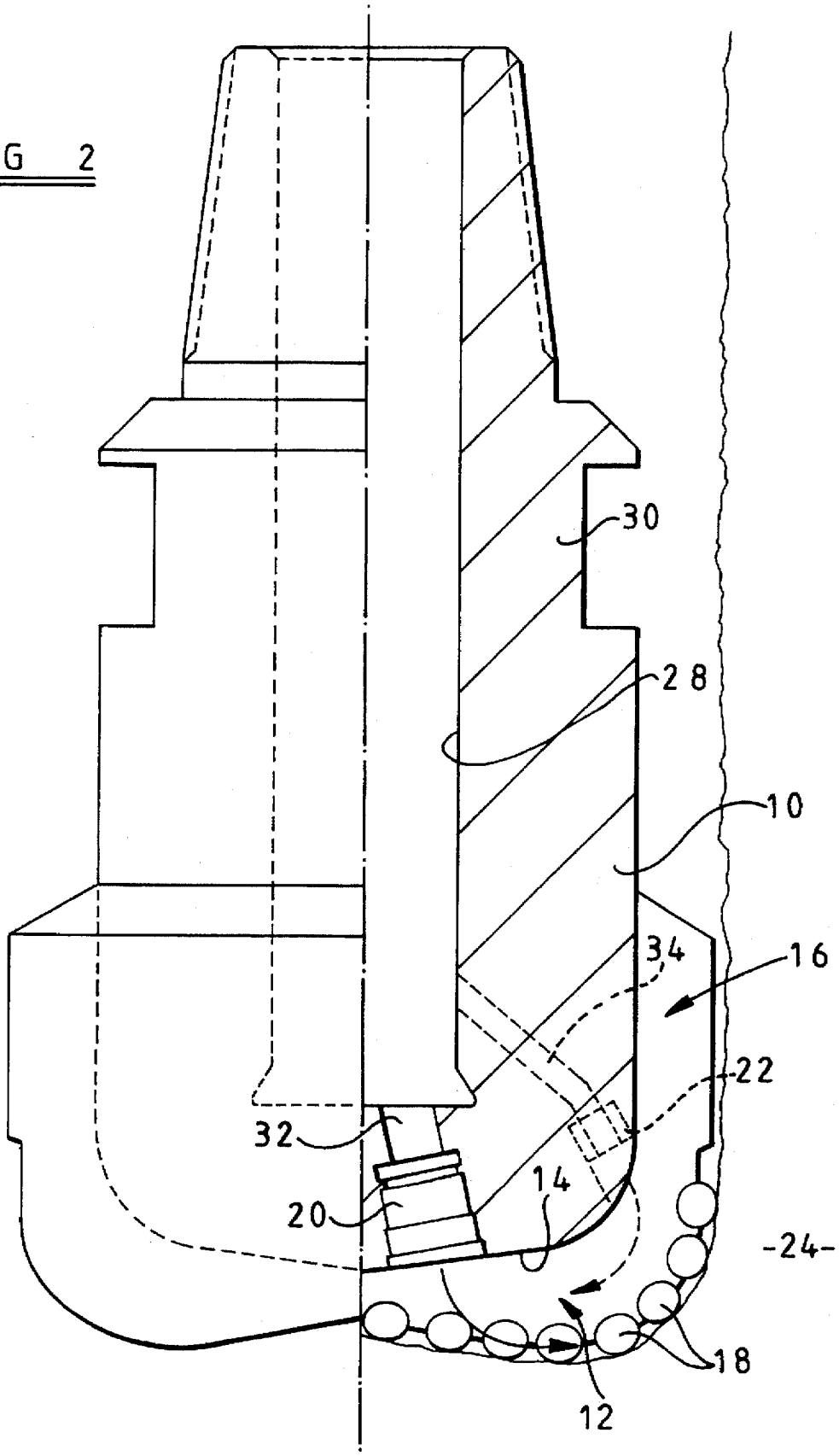
FIG. 2 is a part longitudinal section, part elevation of the drill bit of FIG. 1.

As may be seen from FIG. 2 all of the nozzles communicate with a central axial passage 28 in the shank 30 of the bit to which drilling fluid is supplied under pressure downwardly through the drill string in known manner. The nozzles 20, 22 communicate with passage 28 through passages 32, 34 respectively.

In accordance with the invention the nozzles 20, 22 in each flow channel comprise a main nozzle 20 and a subsidiary nozzle 22. Each main nozzle 20 is located in the vicinity of the central axis of the drill bit, close to the leading edge 24 of the blade on which the cutters 18 face into the flow channel 14. The main nozzle 20 is so orientated that the majority of drilling fluid emerging therefrom flows outwardly along the leading edge 24 so as to clean and cool the cutters 18.

The subsidiary nozzle 22 is spaced both radially and circumferentially of the main nozzle 20. It is located near the outer periphery of the bit body and is spaced circumferentially forward of the main nozzle 20 so as to lie adjacent the trailing edge 26 of the next preceding blade. The subsidiary nozzle 22 is so orientated that the majority of fluid emerging therefrom flows inwardly along the trailing edge 26 of the next preceding blade. In the arrangement shown each subsidiary nozzle 22 is located in the transition region between a flow channel 14 and its associated junk slot 16. However, the subsidiary nozzle could also be located in the main part of the flow channel or the main part of the junk slot. As shown in FIG. 2, the subsidiary nozzle may be located in a socket which communicates with the surface of the flow channel and/or junk slot, instead of being itself located at the surface.

The main nozzle 20 and subsidiary nozzle 22 thus direct drilling fluid in opposite radial directions at circumferentially spaced locations, and this tends to impose a rotating flow (anticlockwise as seen in FIG. 1) on the general flow of drilling fluid along each fluid channel 14. It is believed that such rotating flow enhances the cooling and cleaning effect of the fluid flow.

In order to assist in stabilizing the flow in each flow channel 14, an upstanding central rib may be mounted in the channel between the streams of fluid from the main and subsidiary nozzles. One such rib is indicated diagrammatically in broken line at 28 in FIG. 1. The rib may extend along the outer part of the flow channel 14 and partly into the associated junk slot.

In the arrangement shown main and subsidiary nozzles are provided in each of the six flow channels 14 between the blades 12. However, this is not essential to the invention and advantage may be achieved by providing main and subsidiary nozzles, arranged as shown, in only some of the flow channels 14, for example in alternate channels. In that case flow in the other flow channels may be effected in conventional manner by a single nozzle directing flow along that channel, or the main nozzles may be so orientated that a proportion of the drilling fluid emerging therefrom also flows outwardly along the adjacent flow channel.

Figure 3:
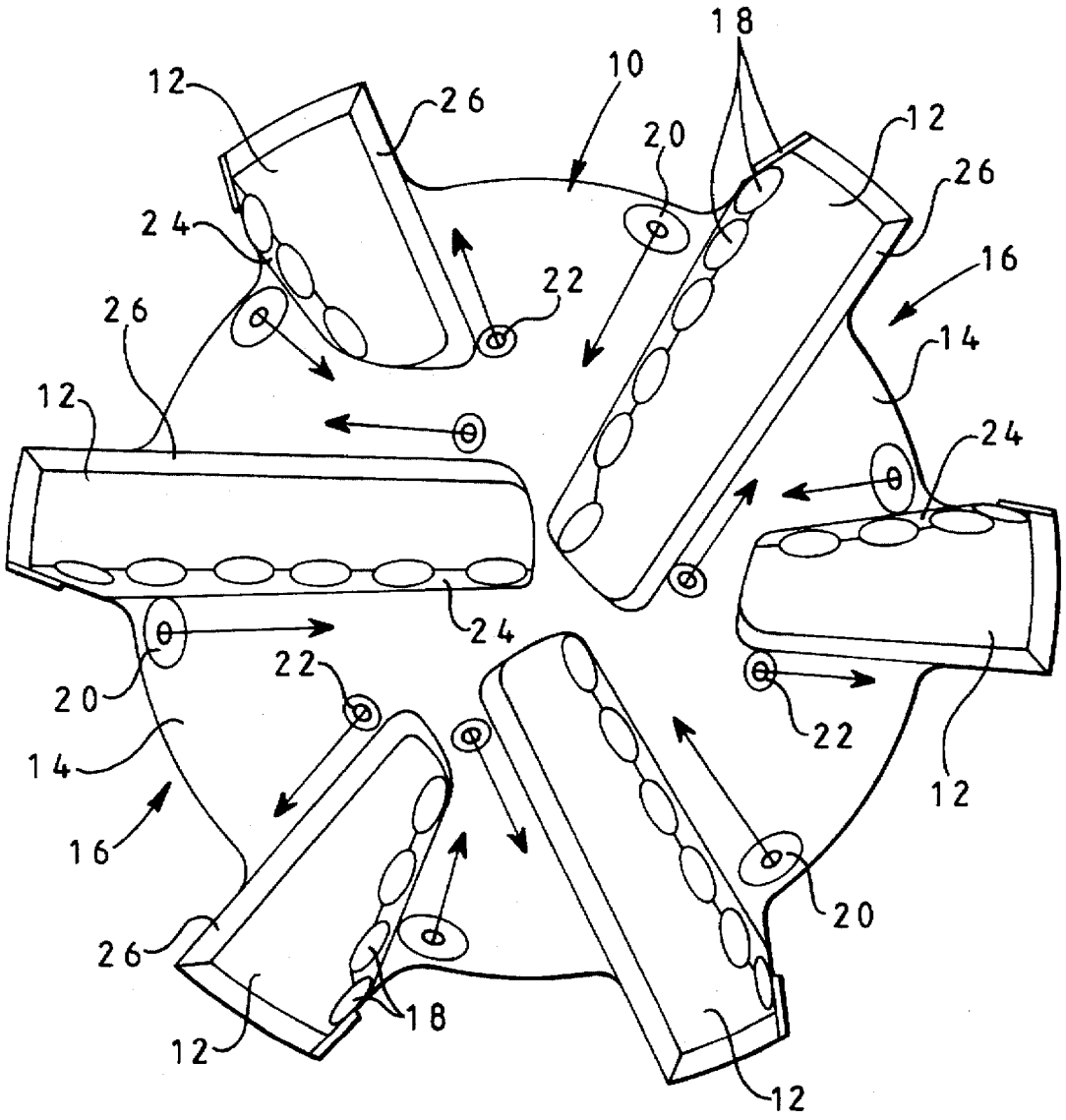
FIG. 3 is a similar view to FIG. 1 of an alternative embodiment.

FIG. 3 shows diagrammatically a modification of the arrangement of FIG. 1 where the main nozzle 20, for directing drilling fluid along the cutters 18, is located adjacent the outer periphery of the drill bit so that the main flow of drilling fluid is inwardly towards the axis of the drill bit. The associated subsidiary nozzle 22 is, in this case, located near the central axis so as to direct its flow of drilling fluid outwardly.

Normally, the main nozzle 20, serving to cool and clean the cutting elements 18 most directly, will have a greater flow rate than the subsidiary nozzle 22, the main purpose of which is to generate the rotating flow. However, the invention does not exclude arrangements where the flow rate of the subsidiary nozzle is equal to or greater than the flow rate from the main nozzle.

Although in the arrangements shown there is a single main and subsidiary nozzle in each flow channel, two or more main nozzles and/or two or more subsidiary nozzles may be provided to enhance the recirculation of flow.

With reference to FIG. 2, the orientation of the main and subsidiary nozzles may be such that the flow from one of the nozzles is nearer the surface of the flow channel 14 than the other, so as to generate flow which also tends to recirculate in a vertical plane, i.e., in a plane generally parallel to the longitudinal axis of the drill bit. In the arrangement of FIG. 2 the flow from the outer subsidiary nozzle 22 is nearer the surface of the flow channel, but the opposite arrangement is also possible, so that the direction of recirculation in the vertical plane is reversed.

Whereas the present invention has been described in particular relation to the drawings attached hereto, it should be understood that other and further modifications, apart from those shown or suggested herein, may be made within the scope and spirit of the present invention.

What is claimed:

1. A rotary drill bit for use in drilling holes in subsurface formations comprising a bit body having a leading face and a gauge region, a plurality of blades formed on the leading face of the bit body and extending outwardly away from the axis of the bit towards the gauge region so as to define a fluid flow channel between the leading edge of each blade and the trailing edge of the adjacent preceding blade, and a plurality of curing elements mounted along the leading edge of each blade, wherein there is provided, in at least one of said channels, a main nozzle which is located and orientated so as to direct at least the majority of fluid emerging therefrom along the leading edge of one blade so as to clean and cool the cutting elements mounted thereon, and a subsidiary nozzle which is located and orientated so as to direct at least the majority of fluid emerging therefrom along the trailing edge of the blade preceding said one blade in a direction substantially opposite to the direction of flow of fluid from the main nozzle, so as to tend to enhance partial recirculation of fluid flow in said flow channel between the blades.

2. A drill bit according to claim 1, wherein the subsidiary nozzle is spaced radially from said main nozzle.

3. A drill bit according to claim 2, wherein one nozzle is located adjacent the center of the bit and the other nozzle is located adjacent the outer periphery of the bit.

4. A drill bit according to claim 1, wherein the subsidiary nozzle is spaced forwardly from the main nozzle in a circumferential direction.

5. A drill bit according to claim 1, wherein the main nozzle is located and orientated to direct at least the majority of fluid emerging therefrom outwardly away from the central axis of the bit, the subsidiary nozzle being located and orientated to direct at least the majority of fluid emerging therefrom inwardly towards the central axis of the bit.

6. A drill bit according to claim 1, wherein the main nozzle is located and orientated to direct at least the majority of fluid emerging therefrom inwardly towards the central axis of the bit, the subsidiary nozzle being located and orientated to direct at least the majority of fluid emerging therefrom outwardly away from the central axis.

7. A drill bit according to claim 1, wherein the main nozzle is such as to generate a greater flow rate than the subsidiary nozzle.

8. A drill bit according to claim 1, wherein the subsidiary nozzle is such as to generate a greater flow rate than the main nozzle.

9. A drill bit according to claim 1, wherein main and subsidiary nozzles are provided in all of the flow channels provided on the bit body.

10. A drill bit according to claim 1, wherein main and subsidiary nozzles according to the invention are provided only in alternate flow channels around the bit.

11. A drill bit according to claim 1, wherein an upstanding elongate rib is provided in at least an outer portion of a flow channel in which said main and subsidiary nozzles are provided, said rib being disposed generally between the streams of fluid from the nozzles.

12. A drill bit according to claim 1, wherein the orientation of the main and subsidiary nozzles is such that the flow of fluid from one of the nozzles is generally closer to the surface of the flow channel than the flow from the other nozzle, so as to tend to generate recirculation of fluid flow in the flow channel in a plane which is generally parallel to the longitudinal axis of the drill bit.

* * * * *

UNITED STATES PATENT AND TRADEMARK OFFICE

CERTIFICATE OF CORRECTION

PATENT NO. : 5,699,868
DATED : December 23, 1997
INVENTOR(S) : Douglas Caraway, et al It is certified that error appears in the above-indentified patent and that said Letters Patent is hereby corrected as shown below:

At column 4, line 37, in the phrase "and a plurality of curing elements mounted along", the word "curing" should read --cutting--.

Signed and Sealed this

Twenty-third Day of June, 1998

*Attest:*

*Attesting Officer*

BRUCE LEHMAN

*Commissioner of Patents and Trademarks*